United States Patent [19]

Hunnicutt

[11] 3,942,191

[45] Mar. 9, 1976

[54] SNAP-ON NECKTIE AND DEVICE FOR CONVERING ORDINARY FOUR-IN-HAND NECKTIE FOR SNAP-ON USAGE

[76] Inventor: Cecil C. Hunnicutt, 206 Harrison St., Sabetha, Kans. 66534

[22] Filed: Jan. 2, 1975

[21] Appl. No.: 537,899

[52] U.S. Cl. ..... 2/145; 2/153

[51] Int. Cl.[2] ..... A41D 25/04

[58] Field of Search ..... 2/144, 145, 146, 147, 148, 2/149, 150, 151, 152 R, 152 A, 153, 154, 155, 156, 157; 24/208 R, DIG. 16, 73 PF, 73 PM, 81 A

[56] References Cited

UNITED STATES PATENTS

| | | | |
|---|---|---|---|
| 1,227,053 | 5/1917 | Hoople | 2/155 |
| 1,621,753 | 3/1927 | Romanoff | 2/155 |
| 1,897,333 | 2/1933 | Resseguie | 2/155 X |
| 2,002,825 | 5/1935 | McWhirter | 2/155 |
| 3,737,917 | 6/1973 | Orr | 2/150 |
| 3,737,943 | 6/1973 | Störe | 24/73 PF X |
| 3,872,513 | 3/1975 | Beaudin, Jr. et al. | 2/155 |

FOREIGN PATENTS OR APPLICATIONS

| | | | |
|---|---|---|---|
| 691,009 | 5/1940 | Germany | 2/144 |

*Primary Examiner*—Warner H. Schroeder
*Assistant Examiner*—Moshe I. Cohen
*Attorney, Agent, or Firm*—John A. Hamilton

[57] ABSTRACT

A four-in-hand necktie adapted to be hand-tied in the usual manner, but being divided intermediate its ends into two sections joined by a separable fastener so positioned as to be disposed in the neck band portion of the necktie when it is tied, whereby once it is tied, it can be applied or removed by use of the fastener, leaving the knot tied at all times. The fastener is of a special construction adapting it for use in converting any pre-existing four-in-hand necktie to snap-on usage.

1 Claim, 6 Drawing Figures

SNAP-ON NECKTIE AND DEVICE FOR CONVERING ORDINARY FOUR-IN-HAND NECKTIE FOR SNAP-ON USAGE

This invention relates to new and useful improvements in neckties, and has particular reference to neckties of the snap-on type, that is, neckties in which the neck band portion is divided transversely and the ends thereof at said division joined by a separable fastener.

All neckties of this general type within my knowledge are supplied with knots pre-tied by the manufacturer, and usually said knot is of a special construction, including more than one length of fabric formed around a rigid or semi-rigid core member, or are otherwise of such construction that they cannot be untied. This construction, despite the speed and convenience in the application and removal of the tie resulting therefrom, gives rise to certain problems. For example, many men habitually have tied their neckties in certain types of knots, and desire to continue the use of their preferred knots even if they switch to the use of snap-on neckties. On the other hand, it is economically impossible for necktie manufacturers to supply neckties with all of the various types and styles of knots, as well as in a full range of patterns, fabrics, and colors. Also, a user may wish to change the type of knot he uses from time to time. Secondly, the pre-tied snap-on necktie must necessarily have a neck band portion the length of which can be adjusted to the neck size of the wearer, and constructions providing for such adjustability represent an added expense, in addition to the fact, if the adjustment is made in definite fixed steps, that they will not provide the precise neck size required by a particular user.

Accordingly, the principal object of the present invention is the provision of a necktie which may be initially hand-tied by the user as he applies it to his neck, in any style of knot he may prefer, in which process the neck band portion is automatically adjusted to his precise neck size, but which thereafter may be removed and reapplied any number of times without untying or re-tying the knot. Generally, this object is accomplished by dividing the tie intermediate its ends into two separate sections at a point thereof which will eventually be disposed in the neck band portion thereof, and providing a separable fastener, such as a snap fastener, for joining the tie sections at said division.

Another object is the provision of a fastening device as described above which is well adapted for use in converting any ordinary four-in-hand necktie for snap-on usage in the manner described.

Other objects are simplicity and economy of construction, and efficiency and dependability of operation.

Figure 1:
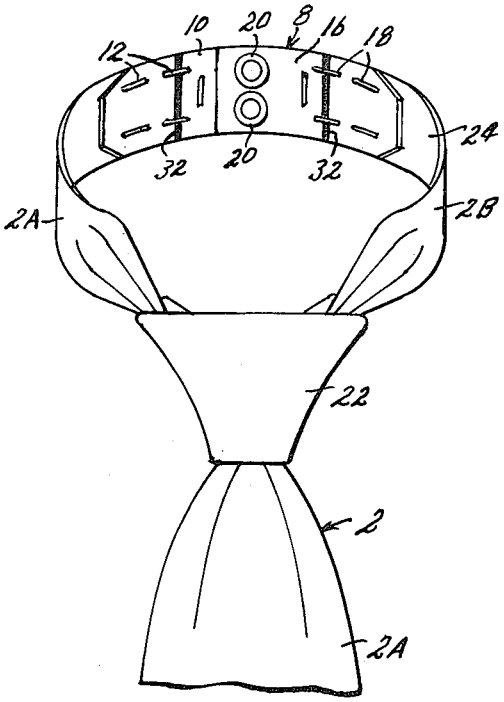
Figure 4:
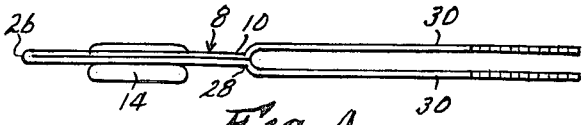
Figure 5:
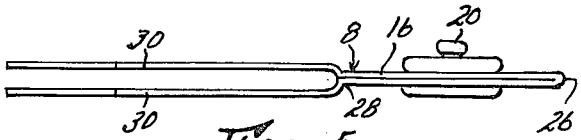
Figure 6:
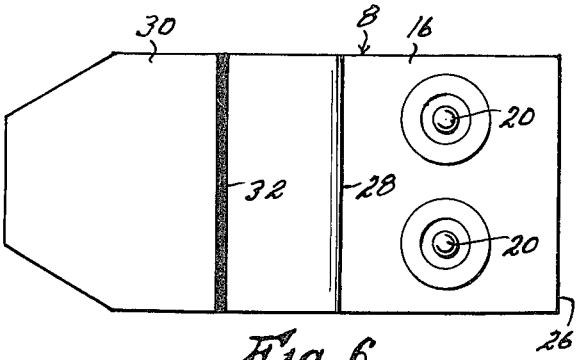
Figure 2:
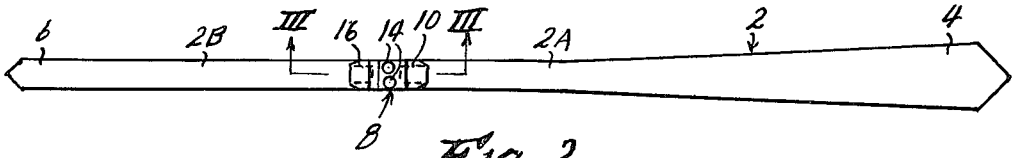
Figure 3:
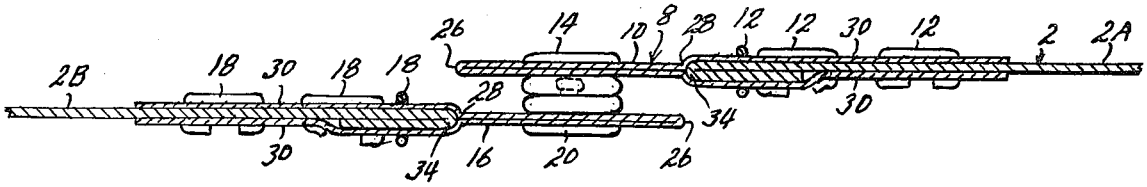

With these objects in view, as well as other objects which will appear in the course of the specification, reference will be had to the accompanying drawing, wherein:

FIG. 1 is a fragmentary front elevational view of a necktie embodying the present invention, shown tied and in a wearing position, FIG. 2 is a reduced, laid-out face view of the necktie as shown in FIG. 1, FIG. 3 is an enlarged, fragmentary sectional view taken on line III—III of FIG. 2, FIGS. 4 and 5 are edge views respectively of the two sections of the fastening device, and FIG. 6 is a face view of the section of the fastening device shown in FIG. 5.

Like reference numerals apply to similar parts throughout the several views, and the numeral 2 applies generally to a necktie having the general configuration of an ordinary four-in-hand tie. As shown in FIG. 2, it has the form of an elongated "tape", usually formed of cloth, being wider at one end 4, tapering to a narrower width at about its midpoint, and remaining at its narrower width, or being only slsightly widened, to its narrower end 6. It is usually tubular, and may be provided interiorly of its tubular form with a partial or full-length liner of buckram or other relatively firm fabric to give it body and resilience. However, the basic structure of the necktie, with regard to its component fabric elements, is not pertinent to the present invention and is not shown.

The necktie 2 is transversely divided intermeidate its ends into two sections 2A and 2B, and said sections are releasably connected together by a separable fastener device designated generally by the numeral 8. As shown, said fastening device includes a flexible tab 10 secured to the end of tie section 2A by staples 12 and having the female elements 14 of one or more friction type snap fasteners secured therein, and a flexible tab 16 secured to the end of tie section 2B by staples 18 and having the male elements 20 of the snap fasteners secured therein.

In use, the necktie thus far described is placed around the wearer's neck and the ends tied in a knot 22 of any style or type the wearer might desire. In tying the knot, the wearer of course automatically adjusts the portion of the tie forming the neck-band 24 thereof accurately to his neck size. If desired, the wearer at this time may insert a safety pin or the like, not shown, into the rearward or concealed portion of the knot, to secure the knot against slipping or loosening. The necktie may then be rmeoved without untying the knot simply by disengaging snap fasteners 14–20, and re-applied by wrapping the neck band 24 about the neck and re-engaging the fasteners.

If the fastening device 8 has been properly positioned relative to the ends of the necktie, it will be disposed in neck band portion 24 thereof when the knot is tied, and will be concealed by the neck band of the wearer's shirt collar. Said fastening device must of course be positioned nearer the narrow end 6 of the tie than to its wider end 4, since the various convolutions of knot 22 are formed in section 2A of the tie, and of course include a substantial portion of the length of the tie. While the tie length included in the knot of course varies with the type of knot to be tied, and while this variation therefore affects the proper placement of the fastening device, it has been found that if the center of the fastening device is positioned about 6–8 inches closer to the narrow end of the tie than to its wider end, it will be disposed within the length of neck band portion 24 of the tie when the knot is tied, regardless of the type of knot used.

The necktie as thus far described could of course be assembled otherwise than shown. For example, if the tie were to be manufactured for snap-on usage by the original manufacturer, the snap fastener elements 14 and 20 could be securely directly in the fabric of tie sections 2A and 2B, rather than by tabs 10 and 16, or if tabs are used, they could be sewed rather than stapled to the tie sections as shown. This would perhaps be neater and more attractive. However, the specific construction of the fastening device actually show adapts it peculiarly for use as a conversion device whereby virtually any pre-existing four-in-hand necktie may be easily and conveniently converted to snap-on usage.

As shown, each of the tabs 10 and 16 of fastening device 8 consists of an elongated strip of pliably flexible plastic film or other suitable material, folded double on itself at its transverse midline, as at 26, and bonded permanently to itself for a distance from said fold, as to the bondline 28. The remaining end lengths of the strip are not secured together, and form flaps 30 of equal length. The male and female fastener elements 20 and 14 are secured respectively in the bonded portions of the two tabs, in spaced apart relation from bond lines 28. An indicator line 32 is imprinted transversely on at least one surface of each of the flaps 30 of the structure, at a distance from bond line 30 equal to the spacing of the centers of fastener elements 14 or 20 from said bond line, but at the opposite side of said bond line.

In the use of a fastening device of this particular construction to convert a pre-existing four-in-hand necktie to snap-on usage, the necktie is first placed about the wearer's neck and tied carefully in the desired style of knot. Then, with the necktie still in place, an assistant severs the neck band 24 transversely, as with scissors, at whatever point the wearer believes will be most convenient for him, for example at either side of the neck, or at the back of the neck. The only precaution in cutting the neck band is that it must not be cut so close to knot 22 that the flaps 30 of the fastening device 8, when that device is applied, would extend into the knot.

The tie, still knotted, is then removed from the neck, and tabs 10 and 16 are applied as follows. Each cut end of the necktie is folded back on itself as indicated at 34 in FIG. 3, and inserted between the separated flaps 30 of its associated tab. The fold 34 is inserted to bond line 28, as shown, and the length of the fold-back is such that the cut end of the tie coincides with indicia line 32. The staples 12 and 18 are then inserted to secure the tabs in place.

It will be seen that if the tabs have been applied carefully as just described, the circumference of neck band 24, when the snap fasteners are joined, will be precisely identical to its circumference before it was cut, and that it will therefore still correspond to the wearer's neck size, and fit properly with no further adjustments. The fold-back 34 of the cut necktie ends assists the flaps 30 in preventing fraying of the cut ends, and for the same reason it is desirable that at least one staple pierce the folded portion of the necktie, as shown. The use of staples, rather than sewing or other types of fasteners, has the advantages of speed and convenience, and if the necktie is equipped with a full-length liner, the staples pierce the liner and secure its cut ends with respect to the necktie sheath, thereby preventing slippage of the liner, and preserving the structural integrity and neat appearance of the tie.

While I have shown and described a specific embodiment of my invention, it will be readily apparent that many minor changes of structure and operation could be made without departing from the spirit of the invention.

What I claim as new and desire to protect by Letters Patent is:

1. A device for converting an ordinary four-in-hand necktie for snap-on usage, when said necktie is transversely severed intermediate its ends, said device comprising:

a. a pair of tabs adapted to be secured respectively to the severed ends of said necktie, each of said tabs comprising an elongated double layer of flexible sheet material, said layers being bonded together at one end portion of said tab to a transverse bond line spaced apart from the opposite end of said tab, the opposite end portions of said layers constituting free flaps adapted to receive the associated severed end portion of said necktie therebetween, b. a separable fastener including a pair of mating elements secured respectively to said tabs, each fastener element being secured in the bonded portion of its associated tab in spaced apart relation from the bond line of said tab, at least one of said flaps of each tab having a transverse indicia line imprinted thereon at a distance from said bond line equal to the spacing of said fastener element at the opposite side of said bond line, whereby if the cut end portion of said necktie is inserted between said flaps to said bond line, while folded on itself so that its extreme end extends to said indicia line, the length of said necktie will not be changed by insertion of said device, and c. means for securing the flap portions of each of said tabs to the necktie end portion disposed therebetween.

* * * * *